US006875961B1

(12) United States Patent
Collins

(10) Patent No.: US 6,875,961 B1
(45) Date of Patent: Apr. 5, 2005

(54) METHOD AND MEANS FOR CONTROLLING ELECTRICAL DISTRIBUTION

(75) Inventor: Jeffrey W. Collins, Chatsworth, CA (US)

(73) Assignee: Thornbury Investments, Inc., Valencia, CA (US)

( * ) Notice: Subject to any disclaimer, the term of this patent is extended or adjusted under 35 U.S.C. 154(b) by 0 days.

(21) Appl. No.: 10/379,695

(22) Filed: Mar. 6, 2003

(51) Int. Cl.[7] ..... H05B 1/02

(52) U.S. Cl. ..... 219/494; 219/497; 219/485; 219/506; 361/2; 361/15; 4/541.2; 4/541.1; 4/545

(58) Field of Search ..... 219/494, 497, 219/485, 506, 519; 361/2, 15; 4/541.2, 541.1, 545

(56) References Cited

U.S. PATENT DOCUMENTS 5,361,215 A 11/1994 Tompkins
5,559,720 A * 9/1996 Tompkins et al. ..... 700/300

* cited by examiner

*Primary Examiner*—Shawntina Fuqua
(74) *Attorney, Agent, or Firm*—William W. Haefliger

(57) ABSTRACT

Apparatus for controlling heating of a liquid or liquid stream including electrical equipment operated in conjunction with such heating; a device or devices for monitoring the voltage level of electrical power supplied to such equipment; and a control or controls for controlling such electrical power supplied to that equipment, to decrease power delivery in response to a predetermined decrease in voltage level of power supply to the equipment.

23 Claims, 5 Drawing Sheets

METHOD AND MEANS FOR CONTROLLING ELECTRICAL DISTRIBUTION

BACKGROUND OF THE INVENTION

Figure 1:
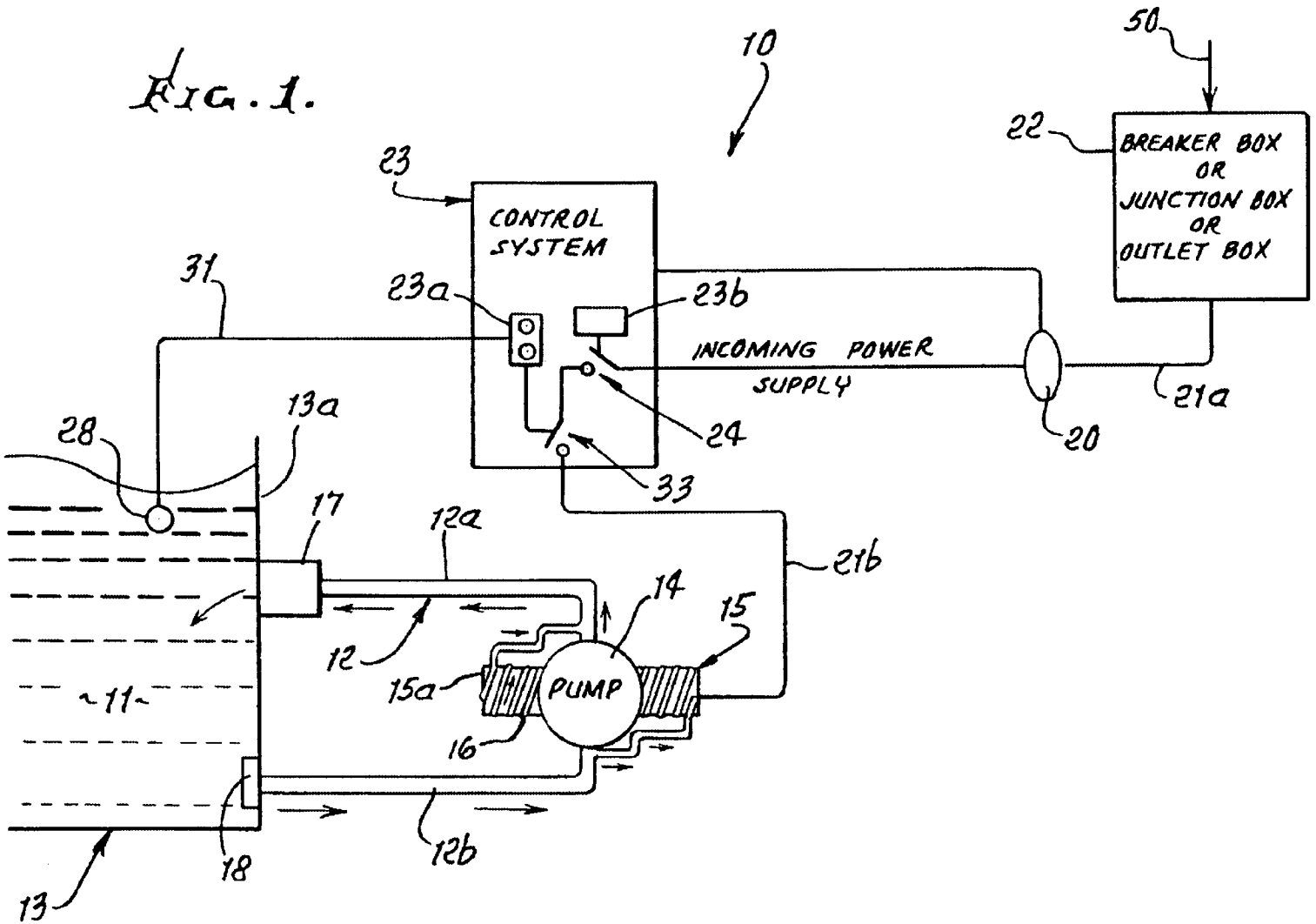

This invention relates generally to the control of electrical power distribution, and more particularly limiting overheating due to supply voltage reduction, the invention having particular application to electrical equipment associated with operation of pools or spas.

U.S. Pat. No. 5,133,818 discloses operation of a water pump for circulating water to and from a spa or hot tub, the pump driven by an electrical motor from which heat is transferred to the circulating water stream. If the supply voltage to the motor and/or heater appliance drops, electrical current supplied to the motor and/or heater appliance can increase significantly, resulting in risk of electrical overheating and risk of damage to electrical circuitry or components. There is a need for method and means to alleviate these problems, as well as in other applications or systems. There is also need for means to control electrical power delivery to the pump motor and/or heater appliance, as a function of changes in motor and/or heater appliance supply voltage level.

SUMMARY OF THE INVENTION

It is a major object of the invention to provide a solution to the above problem or problems. Basically, the method of controlling electrical power delivery, as for example when a motor driven pump and/or heater appliance is operated, includes the steps a) operating a pump motor, and/or heater, for circulating a stream of water to and from the body of water, the motor being an electric motor, the heater being electric, gas or kinetic, operating to heat the water, b) monitoring the voltage level of electric power to be delivered or being delivered to the motor and/or heater, c) and controlling electrical power delivery to the motor and/or heater in response to said b) monitoring.

As will appear, such controlling of electrical power delivery operates to decrease or shut off electrical power delivery to the motor and/or heater when such voltage level monitoring detects a lowering of voltage level below a predetermined voltage level threshold.

It is another object of the invention to provide for controlling electrical power delivery operating to increase or restore electrical power delivery to the motor when a predetermined secondary condition is met, such as operation of a protectionary device, or when proper voltages are re-established. The voltage level monitoring as referred to preferably provides power delivery to the motor and/or heater when a predetermined threshold has been achieved.

Yet another object includes providing control circuitry to perform said sub-paragraph c) controlling. In this regard, voltage level monitoring is typically effected by providing and operating a voltage level monitor at the voltage input side of the motor and/or heater.

The invention is also applicable to systems that do not incorporate the specific spa or hot tub equipment referred to.

In its apparatus aspects the invention includes a) equipment such as a pump and a pump motor operating to circulate a stream of water to and from the body of water, the motor being an electric motor; or a heater operating to increase the temperatures of the body of water, the heater being electric, gas or kinetic, b) first means for monitoring the voltage level of electric power to be delivered or being delivered to the motor, and/or heater, c) and other means for controlling electrical power delivery to the motor and/or heater in response to said monitoring.

Such equipment may include additional pumps, motors, or other electricity using devices.

More generally, apparatus for controlling heating and circulation of a liquid or liquid stream includes:

a) electrical equipment operated in conjunction with such heating and circulation, b) means for monitoring the voltage level of electrical power supplied to said equipment, c) and control means for controlling said electrical power supplied to said equipment, to decrease or shut off power delivery in response to a predetermined decrease in voltage level of such power supply to said equipment, and to restore power when a predetermined level is re-established.

These and other objects and advantages of the invention, as well as the details of an illustrative embodiment, will be more fully understood from the following specification and drawings, in which:

DRAWING DESCRIPTION

FIGS. 1–6 are system diagrams.

DETAILED DESCRIPTION

FIG. 1 shows one preferred system or apparatus 10 for controlling pump operation and heating of a pool or spa body of water 11, or for controlling heating of a stream 12 of water flowing to or from the body of water 11, as at 12*a* and 12*b*. Liquid other than water is also contemplated, and body 11 could be a reservoir of liquid. Numeral 13 designates the spa or reservoir, having wall 13*a*.

A pump 14 is driven by an electrical motor 15, to pump water or liquid to body 11, and to receive water or liquid from body 11. Typically, heat generated by motor 15 is transferred to the water or liquid being circulated to the body 11. See for example ducting 16 passing in heat transfer relation to the motor, as by coiling about the motor housing 15*a*. Accordingly, the motor is electrically operated as a form of useful heater, in conjunction with operation of a spa. A separate independent heater can be employed.

Numeral 17 indicates a water jet at wall 13*a*, to jet heated water into body 11, and numeral 18 indicates a suction fitting typically at wall 13*a*, to deliver water from body 11 to line 12*b*.

The invention contemplates provision of the following:

i) first means for monitoring the voltage level of electric power to be delivered or being delivered to the motor, and/or to a heater, or other electrically powered device, ii) second means for monitoring the temperature of water in said body of water in the spa or in the stream of water being circulated, iii) and third means for controlling electrical power delivery to the motor, or heater, in response to said i) monitoring and/or said ii) monitoring.

Figure 2:
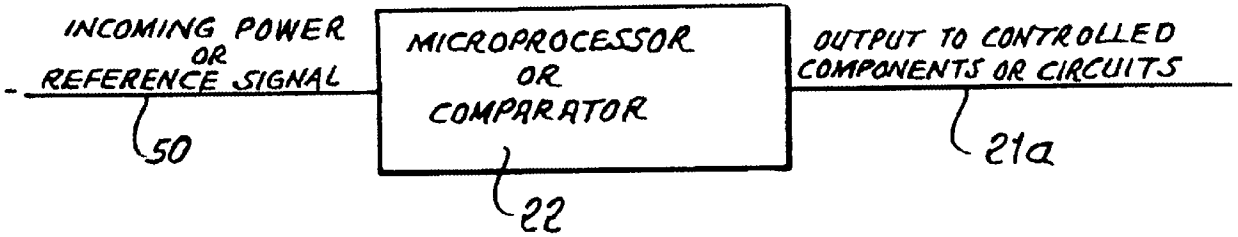

In the example, such first means may typically include a voltage level monitor 20 at the voltage input side of the system, the power supply line or lines indicated at 21*a* and 21*b*. An upstream junction box, or breaker box, or outlet box is indicated at 22. The monitor 20 may comprise a voltage level detector in or at line 21*a*, or a microprocessor or comparator as seen in FIG. 2, incoming power indicated at 50. It operates to sense voltage level, as for example drop to a threshold, below normal voltage level, and to which a control means 23*b* responds, as by opening switch 24, to decrease or eliminate power supply to the motor. This prevents increased current supply to the motor, and increased $I^2R$ losses heating the motor to objectionable levels, and risking damage to circuit components. Control means 23 may be regarded as the above referenced means for controlling electrical power delivery to the motor in response to said c) monitoring and/or said d) monitoring.

Figure 3:
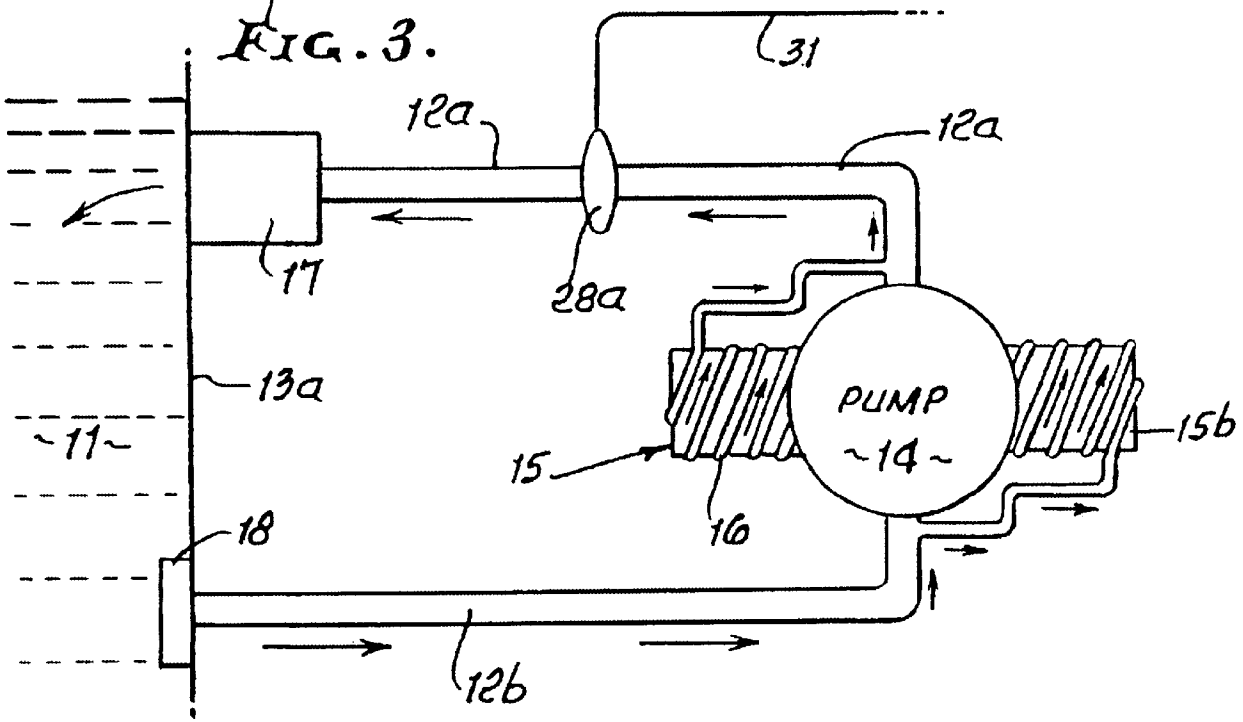

The referenced second means for monitoring the temperature of water in the water body 11, or water flowing to or from the spa, may comprise a temperature level detector 28 seen in FIG. 1, for body 11, or a detector 28*a* in or at the stream of water being circulated, as seen in FIG. 3. Line 31 transmits the temperature level signal to the control means 23*a*, which responds by opening switch 33 in line 21*b*, if the water temperature exceeds a predetermined upper level, or by closing switch 33 if the water temperature drops below a predetermined lower level. Accordingly, water temperature is to be kept within a desired range between the two threshold levels, as best suited to the needs of the bather. Controls 23*a* and 23*b* at the controller 23 may be adjusted to adjust the two threshold levels.

It will be noted that the control system operates to cause opening of voltage level responsive switch 24, irrespective of the open or closed condition of water temperature responsive switch 33, whereby the former dominates or overrides the latter.

The invention, generally, in its method aspects embodies the steps a) operating a pump motor, and/or heater, or auxiliary device, for circulating a stream of water to and from the body of water, the motor being an electric motor, the heater operating to heat the water, b) monitoring the voltage level of electric power to be delivered or being delivered to the motor and/or heater, c) and controlling electrical power delivery to the motor and/or heater in response to said b) monitoring.

The invention, generally, in its apparatus aspects concerns means for controlling circulation of a liquid stream, and embodying:

a) electrical equipment operated in conjunction with such circulation, b) means for monitoring the voltage level of electrical power supplied to said equipment, c) and control means for controlling said electrical power supplied to said equipment, to decrease or shut off power delivery in response to a predetermined decrease in voltage level of such power supply to said equipment.

Such control means may function to re-establish power delivery to the power consuming equipment as when normal supply voltage level is re-established.

Figure 4:
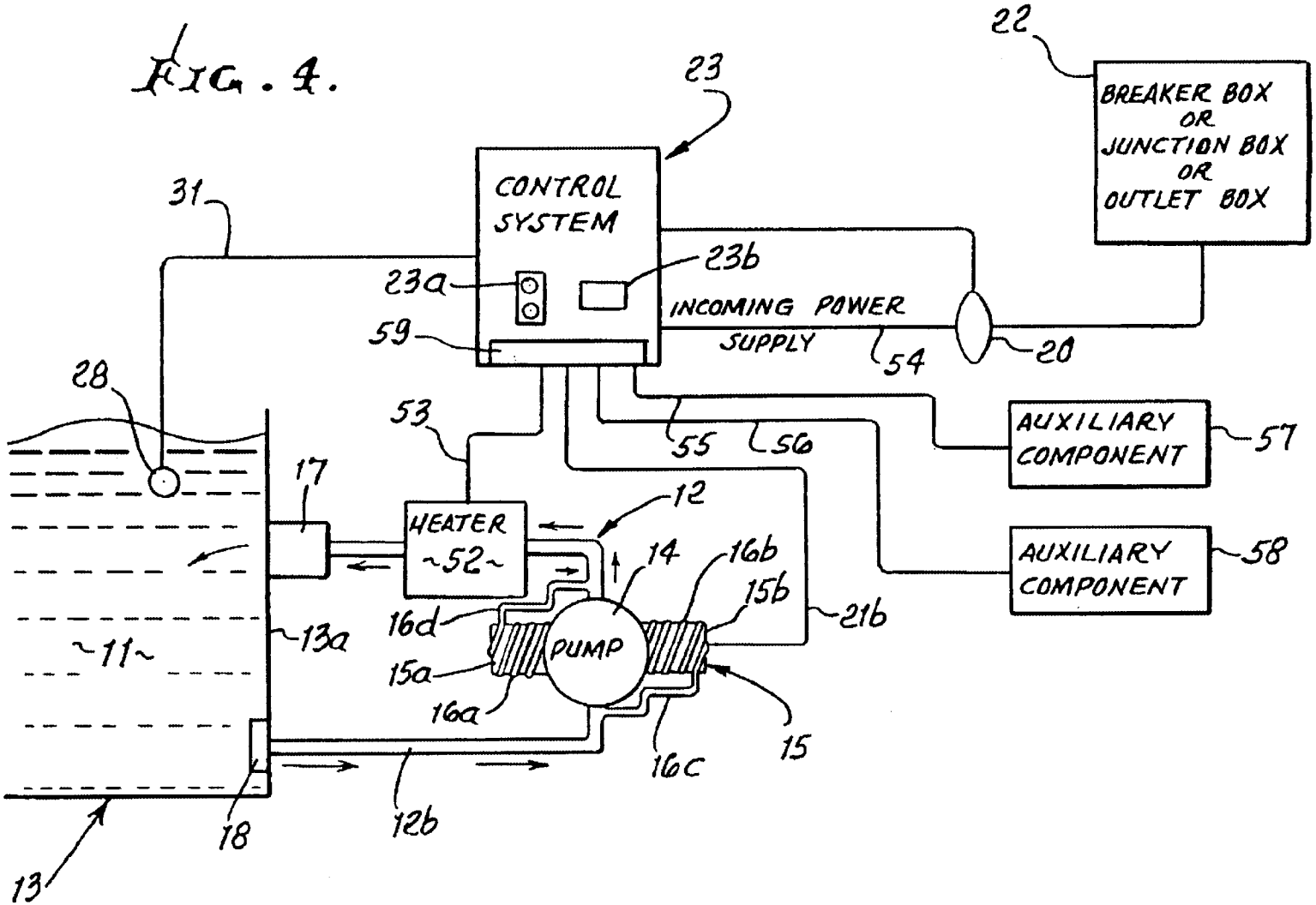

FIG. 4 shows a modified system, with elements corresponding to certain FIGS. 1–3 elements bearing the same numerals. Pump 14 is driven by motor 15 having two sections 15*a* and 15*b*. Ducting 16 is coiled at 16*a* and 16*b* about the sections 15*a* and 15*b*, to receive heat generated during motor operation. Ducting 16*b* receives liquid from duct 12*b* via an input duct 16*c*, and ducting 16*a* receives liquid from 16*b* and passes it via output duct 16*d* to duct 12. Liquid flowing in duct 12 to jet 17 passes through a heater 52 energized by electrical power input at 53 from the control system 23.

Incoming electrical power is delivered to 23 by line 54 from 22.

Auxiliary lines 55 and 56 deliver electrical power from 23 to auxiliary components 57 and 58, associated with the spa.

Monitor 20 at line 54 operates to assess voltage level, as for example a drop to a threshold below normal level. Control 23 responds to decrease or eliminate power delivery via lines 21*b*, 53, 55 and 56 to equipment 15, 52, 57 and 58, in the manner as referred to above. Switches for such lines are located at 59.

Figure 5:
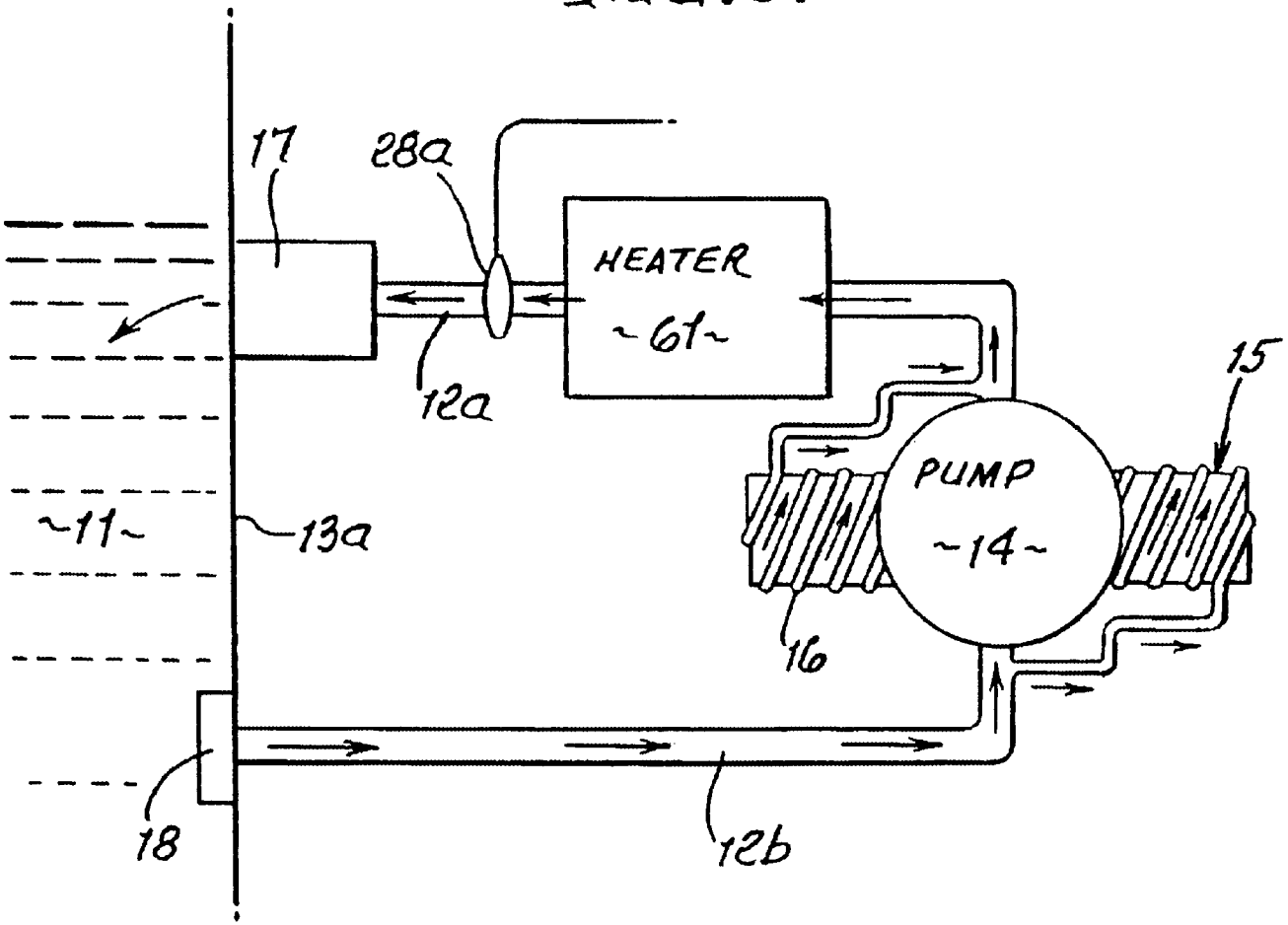

In FIG. 5, the heater 61 is in series with line 12*a*, to heat water flowing to the spa from pump 14. Water temperature level detector 28*a* corresponding to 28, is also located in series with line 12*a*, as shown.

Figure 6:
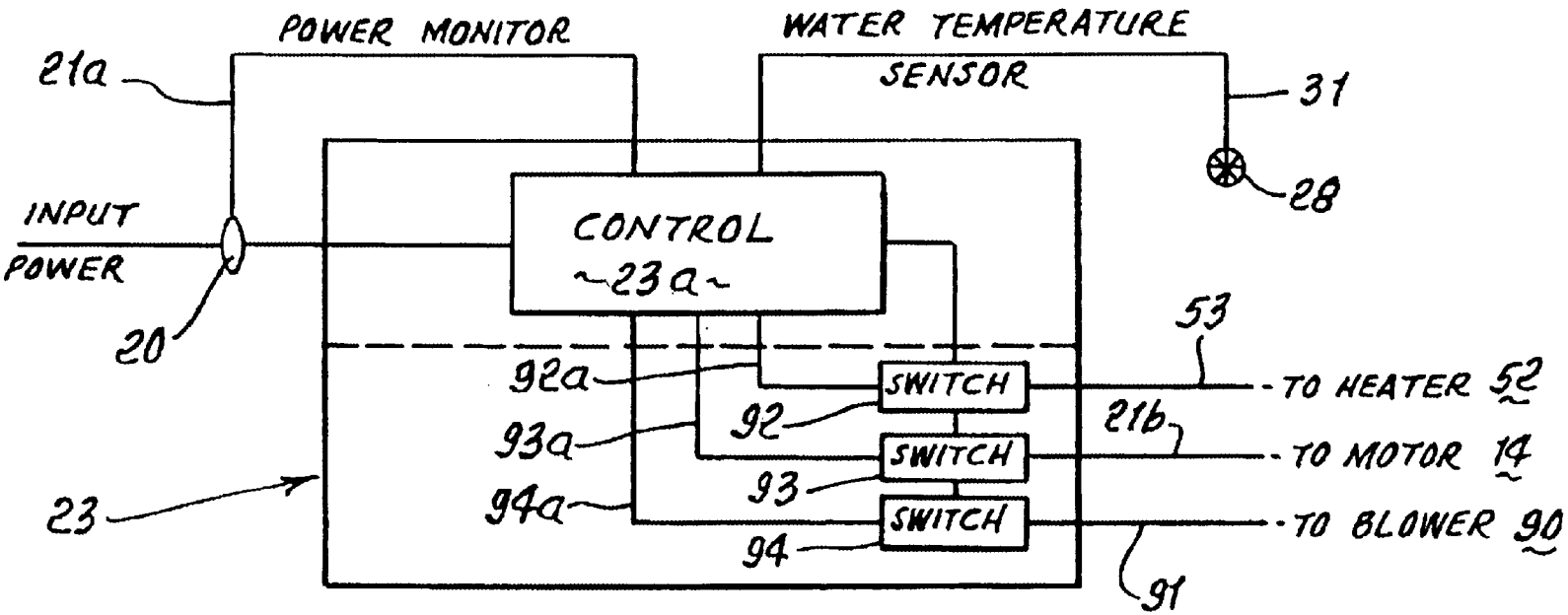

FIG. 6 shows more generally that aspect of the invention concerning maintenance of power supply to control components, as during both maintenance and cut-off of power supply to other components (motor, heater, blower, ozone generator, etc.) in response to changes in supply voltage level.

Control components are shown to include the control system 23, electric power monitor 20 and line 21*a* to control unit 23*a*, and water temperature monitor 28 and line 31 to control unit 23*a*. These components remain supplied with electrical power so as to be operable, even though power may at times be cut-off to to other components (pump motor 14, water heater 61, and blower or ozone generator 90). On-off power delivery control switches 92–94 are shown as in series with lines 53, 21*b* and 91 to the respective other components 52, 14 and 90. Switches are operated by the control unit 23*a*, as via control line or lines indicated at 93. Power delivery lines to the switches are indicated at 92*a*, 93*a* and 94*a*. The control unit 23*a* (for example software) operates to control the supply of power to the power consuming components 52, 14, and 90, in response to monitoring at 20 and 28. If monitored voltage level at 20 drops below a predetermined threshold, switches 92–94 are opened, but power delivery to operate 23*a*, 20 and 28 is not interrupted. Similarly, the control operates to close the switches when full input voltage level is restored. As indicated, provision is made for supply of electrical power to the control components during both maintenance and cut-off of power supply to the power consuming components 52, 14 and 90. This prevents failures (such as control failures), as well as reducing power being consumed during times of heavy external power usage.

I claim:

1. The method of controlling heating of a pool or spa body of liquid, that includes a) operating a pump and a pump motor, for circulating a stream of water to and from the body of water, the motor being an electric motor, b) transferring heat from the motor or from a separate heater, to the stream as it is circulated, c) monitoring the voltage level of electric power to be delivered or being delivered to the motor or heater, d) monitoring the temperature of water in said body of water in the spa or in the stream of water being circulated, e) providing a monitor or monitors operating to effect said monitoring, f) and controlling electrical power delivery to the motor or heater in response to said c) monitoring and/or said d) monitoring, while maintaining electrical power delivery to said monitor or monitors in the event of decrease of power delivery to the motor or heater below a predetermined threshold.

2. The method of claim 1 wherein said controlling of electrical power delivery operates to decrease electrical power delivery to the motor or heater when said voltage level monitoring detects a lowering of voltage level below a predetermined voltage level first threshold.

3. The method of claim 1 wherein said controlling of electrical power delivery operates to increase electrical power delivery to the motor when said water temperature monitoring detects a lowering of water temperature below a predetermined temperature level threshold.

4. The method of claim 2 wherein said controlling of electrical power delivery operates to increase electrical power delivery to the motor when said water temperature monitoring detects a lowering of water temperature below a predetermined temperature level threshold.

5. The method of claim 1 including providing control circuitry to perform said sub-paragraph e) controlling.

6. The method of claim 2 wherein said voltage level monitoring is effected by providing and operating a voltage level monitor at the voltage input side of said motor.

7. The method of claim 3 wherein said water temperature monitoring is effected by providing and operating a water temperature level monitor.

8. The method of claim 6 wherein said voltage level monitor comprises a voltage detector.

9. The method of claim 7 wherein said water temperature level monitor is a temperature detector operated at one of the following locations:

i) in the water body in the spa ii) in said water flow stream.

10. Apparatus for controlling heating of a pool or spa body of liquid or a stream of liquid flowing to or from the pool or spa, that includes, in combination:

a) a pump and a pump motor operating to circulate said stream of water to and from the body of water, the motor being an electric motor, b) transferring heat from the motor or from a separate heater to the stream as it is circulated, or to said body of water, c) first means for monitoring the voltage level of electric power to be delivered or being delivered to the motor, or heater, d) second means for monitoring the temperature of water in said body of water in the spa or in the stream of water be ing circulated, e) and third means for controlling electrical power delivery to the motor or heater in response to said c) monitoring and/or said d) monitoring, while maintaining electrical power delivery to said monitor or monitors in the event of decrease of power delivery to the motor or heater below a predetermined threshold.

11. Apparatus as defined in claim 10 wherein said third means for controlling said electrical power delivery operates to decrease electrical power delivery to the motor when said first means detects a lowering of voltage level below a predetermined voltage level first threshold.

12. Apparatus as defined in claim 10 wherein said third means for controlling of electrical power delivery operates to increase electrical power delivery to the motor when said second means detects a lowering of water temperature below a predetermined temperature level threshold.

13. Apparatus as defined claim 11 wherein said third means for controlling of electrical power delivery operates to increase electrical power delivery to the motor or heater when said second means detects a lowering of water temperature below a predetermined temperature level threshold.

14. Apparatus as defined in claim 10 wherein said third means includes control circuitry to provide said sub-paragraph e) controlling.

15. Apparatus as defined in claim 11 wherein said first means includes a voltage level monitor at the voltage input side of said motor or heater.

16. Apparatus as defined in claim 12 wherein said second means includes a water temperature level detector.

17. Apparatus as defined in claim 15 wherein said first means comprises a voltage detector.

18. Apparatus as defined in claim 16 wherein said second means level monitor is operated at one of the following locations:

i) in the water body in the spa ii) in said water flow stream.

19. Apparatus for controlling heating of a liquid or liquid stream, that includes in combination:

a) electrical equipment operated in conjunction with said heating, b) means for monitoring the voltage level of electrical power supplied to said equipment, c) and control means including a monitor or monitors for controlling said electrical power supplied to said equipment, in response to operation of said monitor or monitors while maintaining electrical power delivery to said monitor or monitors in the event of decrease of power delivery to the electrical equipment below a predetermined threshold.

20. Apparatus as defined in claim 19 wherein said control means includes a liquid temperature monitor, effective to control electrical power delivery to said equipment as a function of liquid temperature level.

21. The method of controlling heating of a pool or spa body of water that includes:

a) providing and operating first components associated with controlling circulating of a stream of water to and from said body of water, and with controllable heating of said water, b) providing and operating second components associated with supply of electrical power to said first components, c) said second components, i) including a monitor or monitors operating to monitor the voltage level of electrical power supplied or to be supplied to said first components, and ii) also operating to monitor the temperature of said water, d) said second components operating to control said supply of power to the first components in response to said i) and ii) monitoring, e) controlling electrical power delivery to the components in response to said c) monitoring and/or said d) monitoring, while maintaining electrical power delivery to said monitor or monitors in the event of decrease of power delivery to the components below a predetermined threshold.

22. The method of claim 21 wherein said first components include one or more of the following:

i) an electrical motor, ii) a water circulation pump and an electrical motor driving said pump, iii) an electrical heater, iv) an electrical heater for heating said water in the pool or spa, in series with said circulating water stream, v) a blower.

23. The method of claim 21 wherein said second components include electrical switches in series with electrical power delivery to said first components, and controlled to cut-off power delivery to said first components, but not to said second components, in the event of monitored voltage level decrease to a predetermined level.

* * * * *